US009095961B1

(12) United States Patent
Lenfest

(10) Patent No.: US 9,095,961 B1
(45) Date of Patent: Aug. 4, 2015

(54) WRENCH EXTENSION WITH MAGNETIC ARM

(76) Inventor: Jeffery M. Lenfest, Clearwater, FL (US)

( * ) Notice: Subject to any disclaimer, the term of this patent is extended or adjusted under 35 U.S.C. 154(b) by 505 days.

(21) Appl. No.: 13/359,582

(22) Filed: Jan. 27, 2012

Related U.S. Application Data

(60) Provisional application No. 61/561,050, filed on Nov. 17, 2011.

(51) Int. Cl.
*B25B 23/00* (2006.01)
*B25G 1/04* (2006.01)

(52) U.S. Cl.
CPC ..... *B25B 23/0021* (2013.01); *B25B 23/0035* (2013.01); *B25G 1/043* (2013.01)

(58) Field of Classification Search
CPC ..... B25B 23/0021; B25B 23/0035; B25B 13/481; B25B 13/06; B25B 13/08; B25B 13/04; B25G 1/043; B25G 1/005
USPC ..... 81/177.2, 177.85, 123, 125, 124.1; 403/322.2, 322.3; 279/81
See application file for complete search history.

(56) References Cited

U.S. PATENT DOCUMENTS

| | | | | |
|---|---|---|---|---|
| 2,671,484 | A * | 3/1954 | Clark | 81/451 |
| 2,718,806 | A * | 9/1955 | Clark | 81/125 |
| 3,126,774 | A | 3/1964 | Carr et al. | |
| 4,898,053 | A * | 2/1990 | Russo | 81/125 |
| 5,836,223 | A * | 11/1998 | Lin | 81/436 |
| 5,916,340 | A * | 6/1999 | Forsyth | 81/125 |
| 6,726,393 | B2 * | 4/2004 | Tsai et al. | 403/109.4 |
| 6,840,142 | B2 * | 1/2005 | Cheng | 81/177.85 |
| 7,905,163 | B1 * | 3/2011 | Chiang | 81/177.9 |
| 8,695,461 | B2 * | 4/2014 | Moss et al. | 81/125 |

* cited by examiner

*Primary Examiner* — Robert Scruggs
(74) *Attorney, Agent, or Firm* — H. John Rizvi; Gold & Rizvi P.A.

(57) ABSTRACT

A wrenching tool extension for attaching to a wrenching handle includes a shaft having a drive end adapted for attachment to a wrenching handle and a head receiving end defining an axial bore and further adapted to receive interchangeable heads. A magnetic arm includes a rod and a magnet affixed to one end of the rod. The magnetic arm is axially received in the axial bore and oriented such that the magnet is positioned at the head receiving end of the shaft and is axially translatable in the bore. A side adjustment feature is positioned on an external intermediate surface of the shaft and is mechanically interfaced with the magnetic arm to axially translate the magnetic arm with respect to the shaft.

17 Claims, 14 Drawing Sheets

WRENCH EXTENSION WITH MAGNETIC ARM

CROSS-REFERENCE TO RELATED APPLICATION

This Non-Provisional Utility application claims the benefit of U.S. Provisional Patent Application Ser. No. 61/561,050 filed on Nov. 17, 2011, which is incorporated herein in its entirety.

FIELD OF THE INVENTION

The present disclosure generally relates to mechanical hand tools, and more particularly to a shaft for a wrenching tool that includes a movable magnetic arm.

BACKGROUND OF THE INVENTION

Mankind has been devising, making, and using tools of one kind or another since before recorded history. Many of these toots are utilized for applying and removing fasteners used for fastening two items together. Fasteners take on many shapes and forms such as clamps, nails, and rivets. However, when a high strength fastener is required, by far the most common fastener is a threaded bolt with a mating threaded nut.

The bolt and nut effectively perform their function as the result of the bolt being received in axially aligned holes in the pieces to be attached one to the other and then threading the nut onto the threaded end of the bolt. The nut is then torqued onto the bolt so that the clamping force generated by the mated pieces creates the necessary frictional force between the mating threads. In order to apply the necessary torque to properly install a bolt and nut fastener, a wrenching tool must be used.

Wrenching tools can be of many types such as those having a handle with a fixed box end or open end affixed at an end of the tool. These ends can be of a fixed size to accept only one size of bolt head or nut, or alternatively, the ends can be adjustable to adapt to multiple bolt head and nut sizes. Such wrenches having heads that are fixed to the handle in a stationary manner must be repeatedly removed and reapplied to the bolt head or nut to achieve the desired torque, and an entire series of wrenches must be available for those with dimensionally fixed ends.

One development in wrenches has been the adoption of a wrenching handle to which a series of differently sized sockets can be attached. In this manner one handle can be utilized for any number of differently sized bolt heads and nuts. Further, ratcheting systems have been incorporated into some wrenching handles so that the socket can be repeatedly and unidirectionally torqued without the socket having to be removed from the bolt head or nut to which it is applied.

Since a large majority of bolts and nuts are fabricated from steel, magnets have been incorporated into tools to assist in keeping the fastener element in engaging contact with the wrenching tool. This is especially helpful where the fastener elements are being applied is areas that are difficult to access with other tools or with the user's hands and fingers. However, some sockets are fabricated as deep well sockets and when mating a relatively short bolt to a nut, the nut or bolt being held by a magnet into the well of the socket may not be able to be mated. Therefore, a wrenching shaft for accepting sockets wherein the shaft has an axially adjustable magnet with a side adjustment mechanism is needed.

SUMMARY OF THE INVENTION

The present disclosure is generally directed to a wrenching tool extension for attaching to a wrenching handle. The wrenching tool extension includes a shaft having a drive end adapted for attachment to a wrenching handle and a head receiving end defining an axial bore and further adapted to receive interchangeable heads. A magnetic arm includes a rod and a magnet affixed to one end of the rod. The magnetic arm is axially received in the axial bore and oriented such that the magnet is positioned at the head receiving end of the shaft and is axially translatable in the bore. A side adjustment feature is positioned on an external intermediate surface of the shaft and is mechanically interfaced with the magnetic arm to axially translate the magnetic arm with respect to the shaft.

In another aspect, the side adjustment feature maintains the magnetic arm in a desired axial position with respect to the shaft.

In a further aspect, the side adjustment feature engages at least one of a plurality of ridges to maintain the magnetic arm in a desired axial position.

In still another aspect, the side adjustment feature includes a frictional element to maintain the magnetic arm in a desired axial position.

In another aspect, head receiving end is elongate and includes an axially movable collar thereon for adjusting the axial position of a tool head received thereon.

In yet another aspect, the axially movable collar includes a locking feature for selectively retaining the movable collar in a selected axial position with respect to the head receiving end.

In a still further aspect the drive end is configured as a fixed handle.

In a further aspect, the wrenching tool extension includes a shaft having a drive end adapted for attachment to a wrenching handle and a head receiving end configured as a multi-faced socket nipple for receiving interchangeable sockets and including a socket retention feature, the head receiving end further defining an axial bore. A magnetic arm includes a rod and a magnet affixed to one end of the rod. The magnetic arm is axially received in the axial bore and oriented such that the magnet is positioned at the head receiving end of the shaft and is axially translatable in the bore. A side adjustment feature is positioned on an external intermediate surface of the shaft and is mechanically interfaced with the magnetic arm to axially translate the magnetic arm with respect to the shaft.

In a still further aspect, the socket retention feature comprises a retention ball extending radially from one of the socket nipple faces.

In another aspect, a biasing spring internally is retained in the socket nipple wherein the biasing spring biases the retention ball to a radially extended position.

In still another aspect, the rod of the magnetic arm includes a cut-away portion thereof defining a recess for clearance of the biasing spring.

In yet another aspect, the rod defines a notch therein, the notch is selectively positionable to be in registration with the retention ball.

In still yet another aspect, the notch in registration with the retention ball comprises a socket releasing configuration, and further wherein the notch in other than registration with the retention ball comprises a socket locking configuration.

In a further aspect, the rod of the magnetic arm defines an axial groove therealong for receiving a portion of the retention ball.

In yet a further aspect, the wrenching tool extension includes a shaft having a drive end adapted for attachment to a wrenching handle and a head receiving end defining an axial bore and further adapted to receive interchangeable heads. A magnetic arm includes a rod and a disc shaped magnet rigidly affixed to one end of the rod. The magnetic arm is axially received in the axial bore and oriented such that the magnet is positioned at the head receiving end of the shaft and is axially translatable in the bore. A side adjustment feature is positioned on an external intermediate surface of the shaft and is mechanically interfaced with the magnetic arm to axially translate the magnetic arm with respect to the shaft.

In still another aspect, the rod comprises an upper rod having the magnet affixed to one end thereof and a lower rod wherein one of the rods includes male threads and an other of the rods includes female threads for removably attaching the rods one to the other.

In a still further aspect, one of the magnet and the rod includes male threads and an other of the magnet and the rod includes female threads for removably attaching the magnet to the rod.

In yet another aspect, a pliant member is interposed between the magnet and the end of the rod to permit the magnet to angularly flex with respect to a longitudinal axis of the rod.

In a further aspect, the magnet and the end of the rod are bifurcated and extendable between a retracted position and an extended position and further wherein the bifurcations are biased one away from another when in the extended position.

In another aspect, the magnet is pivotally attached to the rod end, the magnet being pivotal between an axially aligned orientation and an axially orthogonal position with respect to a longitudinal axis of the rod.

These and other features, aspects, and advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
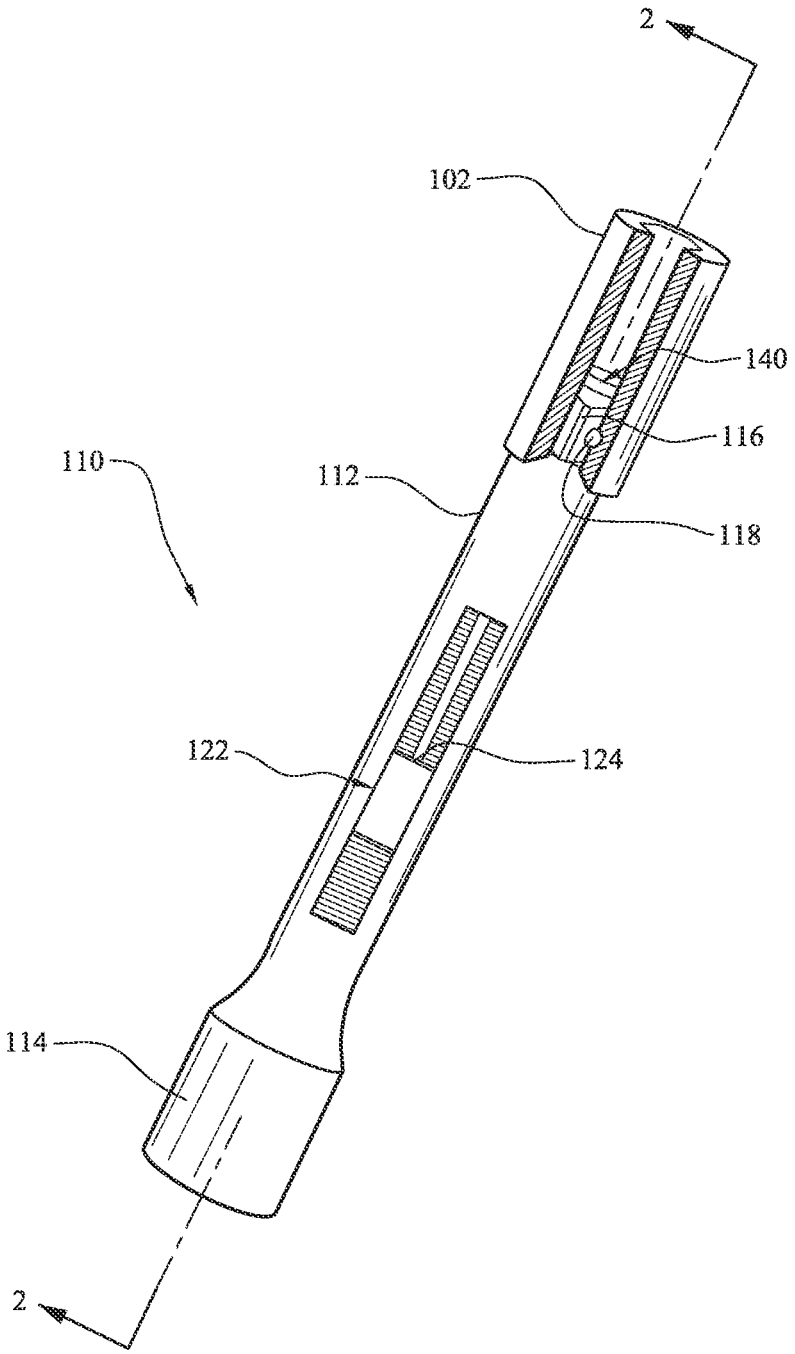
FIG. 1 presents a perspective view of a socket wrench extension embodying the present invention, wherein the shaft includes a central axially adjustable magnet and a side mounted adjustment mechanism.
Figure 2:
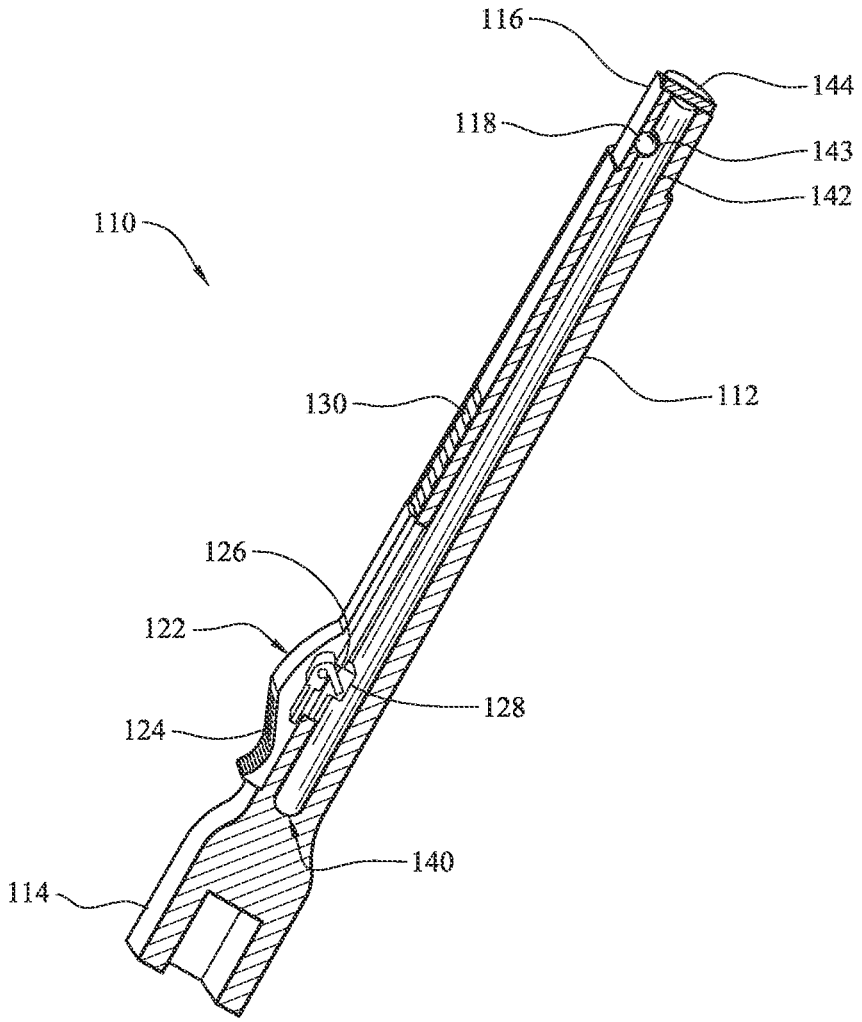
FIG. 2 presents a perspective cross sectional view of the socket wrench extension of FIG. 1 (without a socket attached) taken along line 2-2 of FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear". "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1 through 4 show a wrench extension assembly 110 having a moveable magnetic arm 140 axially translatable therein which is one of the preferred embodiments of the present invention and illustrates its various components. Wrench extension assembly 110 includes a shaft 112 defining a central bore 113 (FIG. 3) having a drive end configured as a female end 114 adapted to be affixed to a wrench handle (not shown) and a head receiving end configured as a male end 116 adapted to securely retain a socket head 102 thereon. Alternatively, the drive end can also be configured in other known configurations such as a fixed handle (not shown) or as an electric motor drive. Male end 116 further includes a spherical retention ball 118 protruding from one surface thereof to aid in securing a socket head 102 thereon. Typically, male end 116 is configured as a multi-faced socket nipple for receiving interchangeable sockets and must usually as a square nipple. Female end 114 is illustrated having a substantially square recess 120 for receiving a male nipple (not shown) of a ratchet handle (also not shown) which are well known in the tool art. Those practiced in the art will also recognize that the concepts and features of wrench extension assembly 110 can also be incorporated in other wrenching tools having a straight shaft with a male end such as male end 116 adapted for receiving socket heads 102 thereon.

Magnetic arm 140 has a magnet 144 affixed to an end of rod 142 in a manner such that when rod 142 is fully received in bore 113 of shaft 112, magnet 144 substantially bears against the end of male end 116. Magnet 144 can be internally threaded to receive therein a threaded end of rod 142 so that magnet 144 can be readily replaced as desired by a user. Rod 142 can be axially translated with respect to shaft 112 to extend magnet 144 away from male end 116. Further, magnetic arm 140 can be extended beyond the open end of socket head 102 to facilitate the attaching or removals of magnet 144.

Figure 3:
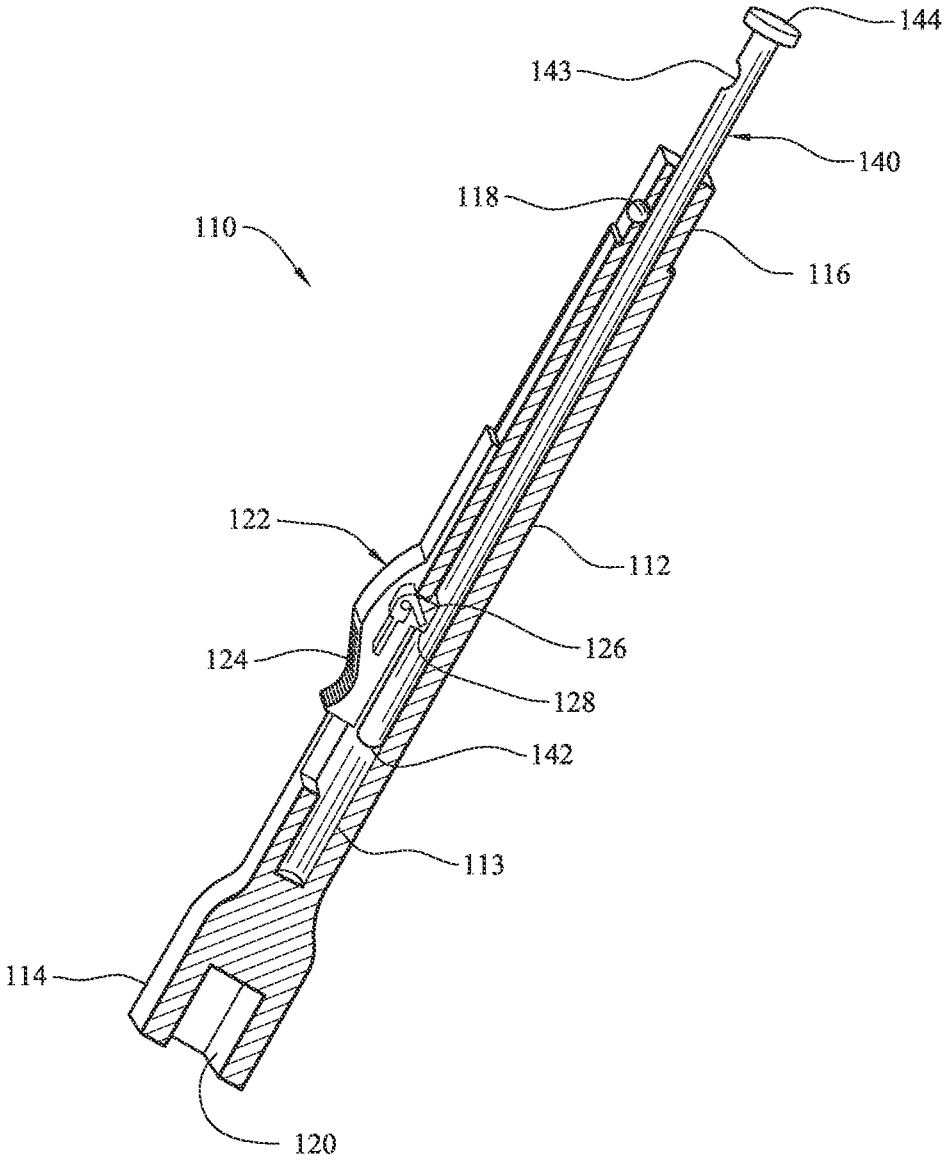
FIG. 3 presents the perspective cross sectional view of the socket wrench extension of FIG. 2 with the magnet in an extended position.

A side adjustment mechanism 122 is positioned on an external intermediate surface of shaft 112 and is mechanically interfaced with magnetic arm 140 to axially translate magnetic arm 140 with respect to shaft 112. Side adjustment mechanism 122 can include a finger operated slide 124 external to shaft 112, which is linked to rod 142 of magnetic arm 140 through a slot in the side of shaft 112. The side adjustment 122 pivots about a pivot pin inserted through a biasing member 126. The biasing member retains the side adjustment 122 in an engaged, locking configuration until a user applies a compression force to the slide 124. The compression force pivots the slide adjustment 122, raising a distal end to disengage the side adjustment 122 from any of a plurality of ridges 130. The ridges 130 are defined in an outer surface of shaft 112 such that as slide 124 and magnetic arm 140 are translated, slide 124 interferingly engages one or more of ridges 130 to positionally maintain slide 124 and magnet 144 of magnetic arm 140 in a desired axial position with respect to male end 116 in a manner known in the art. Alternatively, side adjustment mechanism can include a friction element to maintain slide 124 in a desired axial position. The biasing member 126 can include an arm positioned in a notch 128 or slide against the rod 142. Rod 142 can further include a notch 143 proximate to magnet 144 and positioned to engage ball 118. When magnetic arm 140 is in a retracted position, notch 143 permits ball 118 to be depressed toward a central axis of rod 142 thereby allowing the removal of socket head 102 from male end 116. When magnetic arm 140 is in an extended position (as illustrated in FIG. 3) the external surface of rod 142 bears against ball 118 preventing ball 118 to be depressed toward the central axis of rod 142 and thus maintains ball 118 engaged with socket head 102 and preventing the removal of socket head 102 from male end 116.

Figure 4:
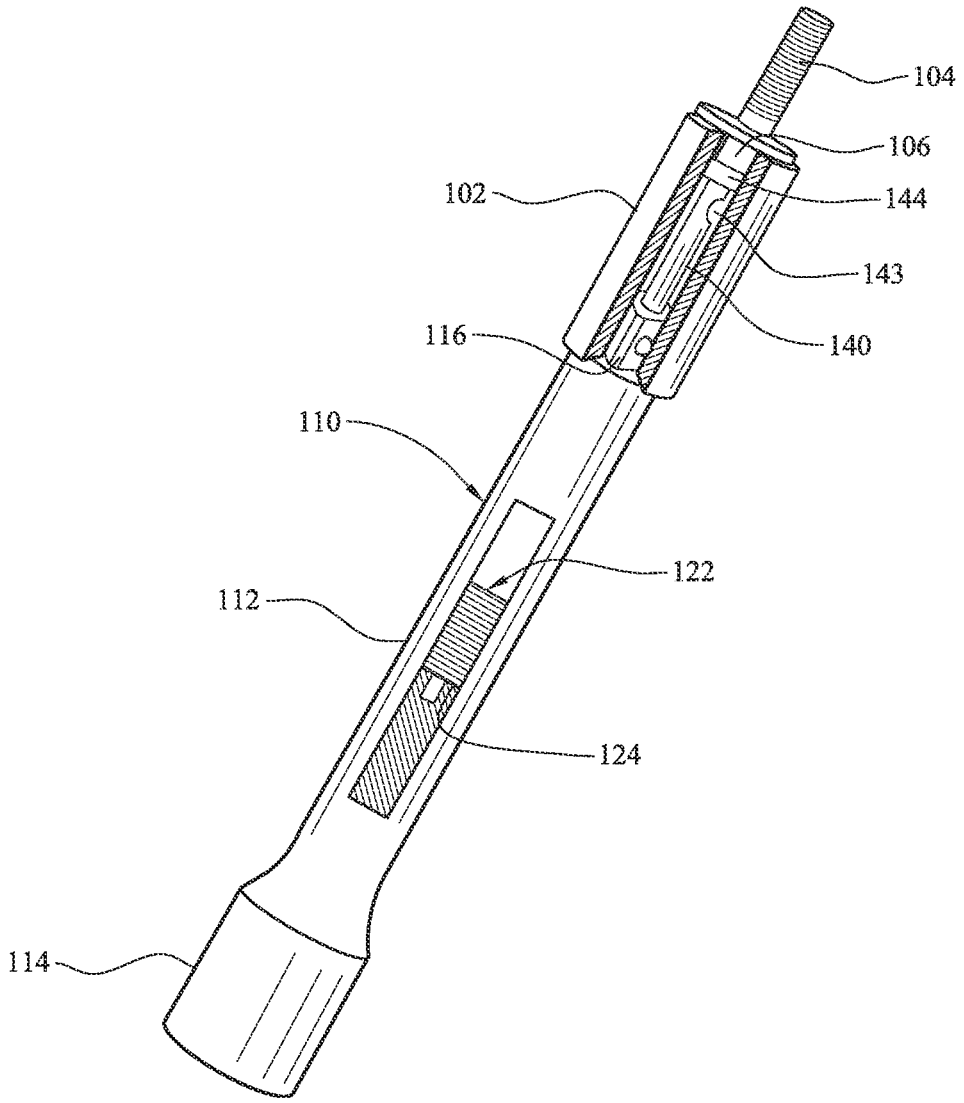
FIG. 4 a perspective view of the socket wrench extension with the magnet in an extended position and including an attached socket in partial section with a bolt head retained within the socket.

As illustrated in FIG. 4, a socket head 102 is engaged on male end 116. Socket head 102 is here depicted as a deep well socket into which bolt head 106 of bolt 104 is received. Slide 124 of side adjustment mechanism 122 and magnetic arm 140 have been axially translated such that magnet 144 is positioned within the well of socket head 102 to bear against bolt head 106. In such manner, bolt 104 is retained within socket head 102 by the magnetic force of magnet 144 operating on bolt 104. Further, by being axially extended close to the open end of socket head 102, bolt 104 is prevented from sliding further into the well of socket head 102, thus facilitating an easier installation of bolt 104 than if bolt head 106 were free to translate the entire length of socket head 102.

Figure 5:
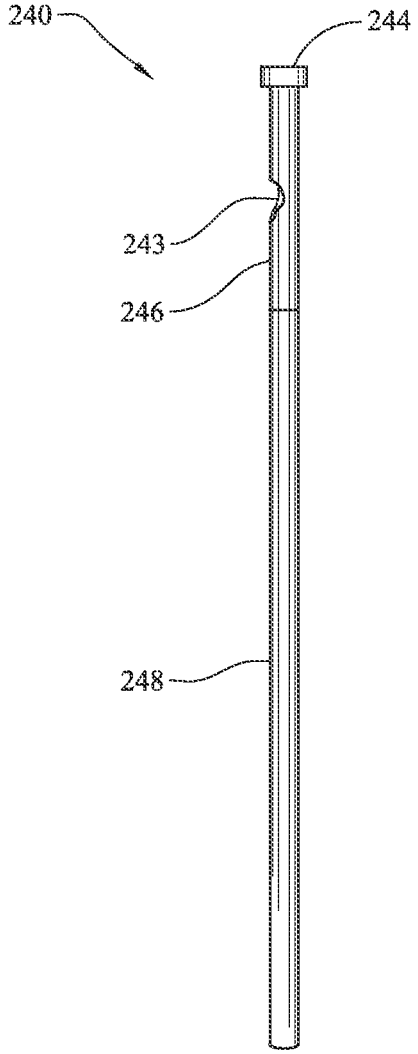
FIG. 5 presents an elevation view of a multi-piece magnet assembly enabling removable and/or interchangeable tips.
Figure 6:
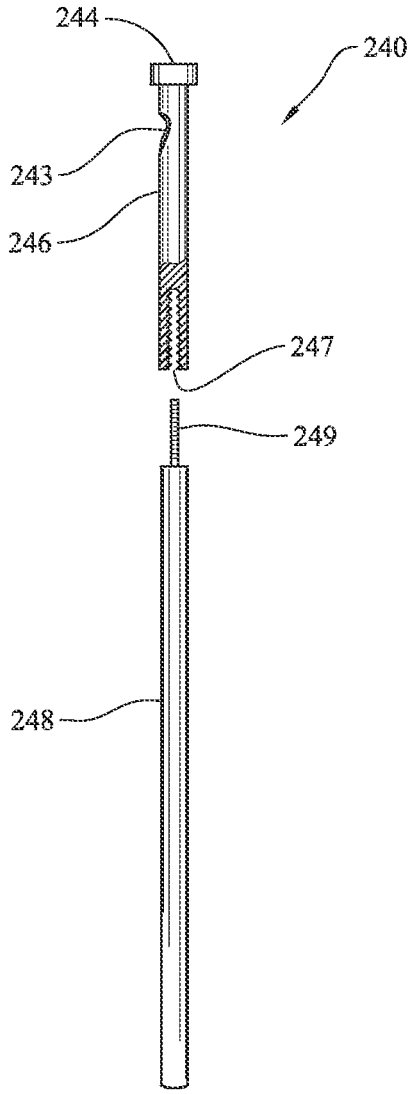
FIG. 6 presents an exploded partial section view of the magnet assembly of FIG. 5.

An alternate embodiment magnetic arm 240 is illustrated in FIGS. 5 and 6. Wrench extensions are typically available in a plurality of lengths and for ease of manufacturing the rod of magnetic arm 240 can comprise an upper rod 246 of a predefined and common length to which is affixed magnet 244 at one end thereof and defining a notch 243 for engagement with a retention ball such as ball 118 (FIG. 1) to enable the attachment and retention of a socket head 102 as previously described above. Upper rod 246 has a threaded hole 247 at an opposite end thereof. To this is mated a lower rod 248 which includes a threaded rod 249 extending from an end thereof to be mated with upper rod 248 and magnet 244. In this manner, this configuration provides the user with several offerings, including the ability to remove and replace the magnetic tip 244 to enhance the separation of the socket head 102 from the wrench extension assembly 110, or to change the overall length of magnetic arm 240 can be tailored to a desired length for a specific wrench extension. Replacement of the magnetic tip 244 enables the user to install different sized, shaped, and/or magnetic strengths as desired. Additionally, the replaceability of the magnetic tip enables the user to employ a notch 243 in any of various configurations. This can include a specific recession as illustrated, a circumferentially shaped recession, and the like.

Figure 7:
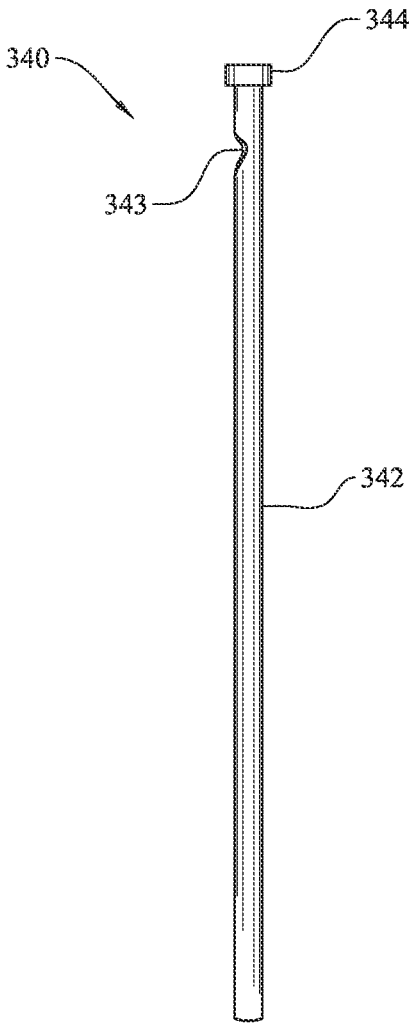
FIG. 7 presents an elevation view of an alternate embodiment magnet assembly wherein the magnet is separable from the rod.
Figure 8:
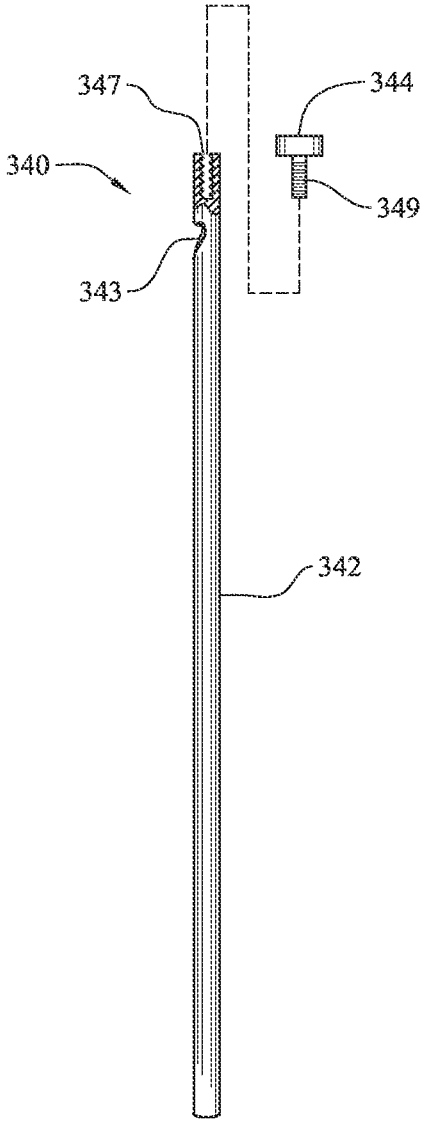
FIG. 8 presents an exploded partial section view of the magnet assembly of FIG. 7.

Another alternate embodiment magnetic arm 340 is shown in FIGS. 7 and 8. Magnetic arm 340 includes a rod 342 defining a notch 343 for engagement with a retention ball such as ball 118 (FIG. 1). An upper end of rod 342 has a threaded hole 347 therein to into which a removable magnet 344 having a threaded rod 349 extending from its bottom can be threaded. In this manner, magnet 344 can be readily removed and replaced without the need to replace the entire magnetic arm 340.

Figure 9:
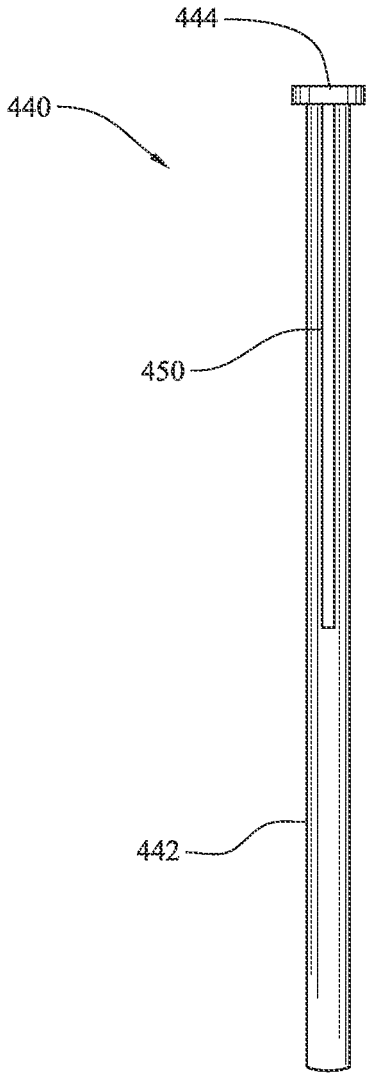
FIG. 9 presents a front elevation view of a magnetic arm to function in a wrench extension having a retention ball for retaining a socket on the extension wherein the magnetic arm includes a groove for receiving a portion of the retention ball.
Figure 14:
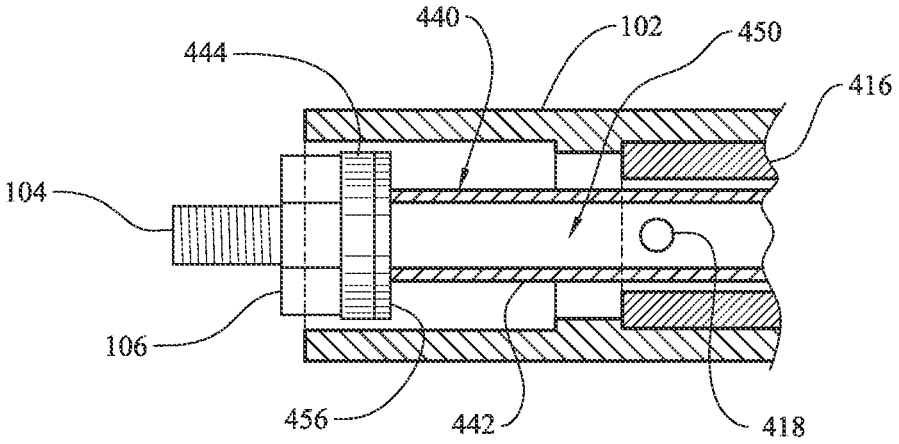
FIG. 14 presents an enlarged cross-sectional view of an alternate embodiment wrench extension incorporating the magnetic arm of FIG. 9 with a socket attached to the end of the extension and a bolt magnetically held in the socket.

An alternate embodiment wrench extension assembly 410 is illustrated in FIGS. 9 and 14; wherein its side adjustment is substantially identical to side adjustment 122 as discussed above and therefore is not shown. Extension 410 incorporates an alternate embodiment magnetic arm 440 (FIG. 9) comprising a magnet 444 affixed to an upper end of a rod 442. Rod 442 can also incorporate a plate 456 (FIG. 14) affixed thereto and wherein magnet 444 is in turn affixed to plate 456. In one embodiment, plate 456 is formed from an insulating material. Rod 442 defines an axially aligned groove 450 extending from magnet 444 down a substantial portion of the length of rod 442. As illustrated in FIG. 14 bolt head 106 of bolt 104 is held to magnet 444 by magnetic force and magnetic arm is adjustable as previously described above to maintain bolt head 106 proximate to the open end of socket head 102. Groove 450 is aligned to receive a portion of retention ball 418 at male end 416 thus maintaining alignment of magnetic arm 440 with respect to the shaft (not shown) of wrench extension assembly 410.

Figure 10:
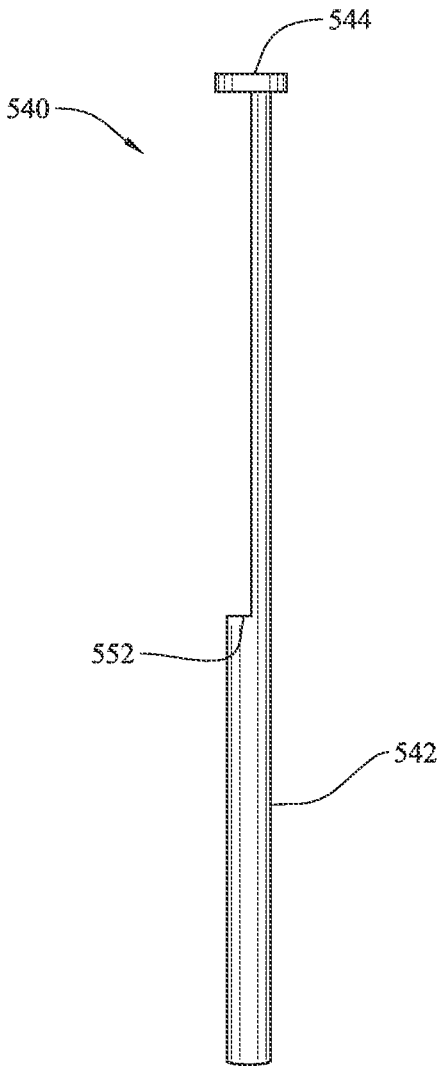
FIG. 10 presents a side elevation view of a magnetic arm for use in a wrench extension having a spring biased retention ball for retaining a socket on the extension wherein the magnetic arm includes a recess for clearing the biasing spring.
Figure 13:
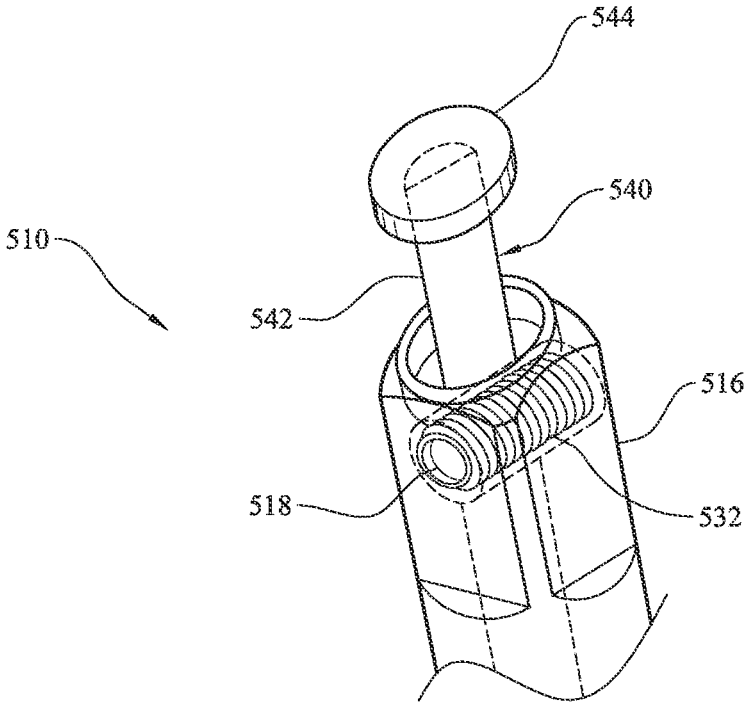
FIG. 13 presents an enlarged perspective view of the socket receiving end of a wrench extension incorporating the magnetic arm of FIG. 10.

Another alternate embodiment wrench extension assembly 510 is illustrated in FIGS. 10 and 13; wherein its side adjustment is substantially identical to side adjustment 122 as discussed above and therefore is not shown. Extension 510 includes at male end 516 a retention ball 518 that is biased outwardly from male end 516 by a biasing spring 532 internal to male end 516. In order to clear biasing spring 532, an alternate embodiment magnetic arm 540 (FIG. 10) comprises a magnet 544 affixed to an upper end of rod 542. Rod 542 has an axial portion thereof cut away and in combination with magnet 544 defines a recess 552, wherein recess 552 provides the requisite clearance for biasing spring 532.

Figure 11:
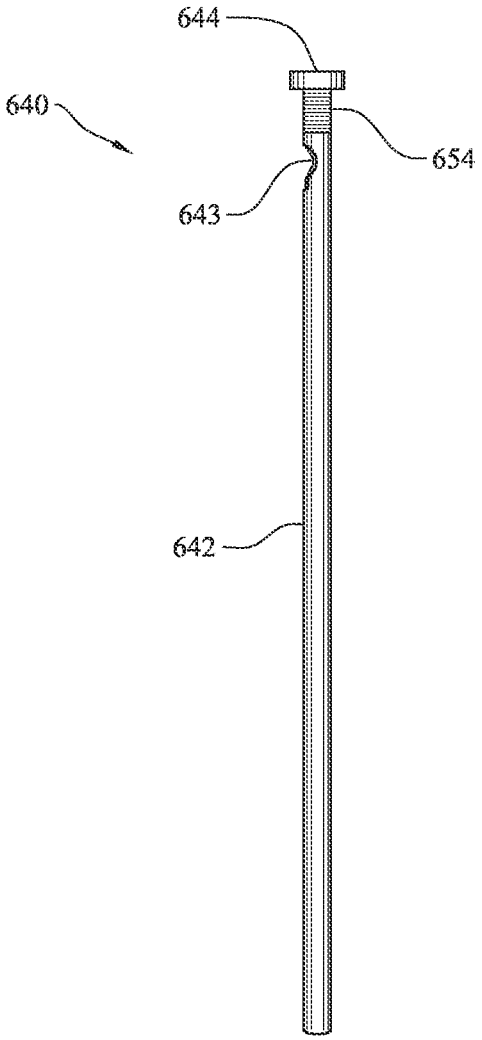
FIG. 11 presents an elevation view of an alternate embodiment magnetic arm assembly wherein the magnet is affixed to a pliant member at the end of the rod.

Yet another alternate embodiment magnetic arm 640 is illustrated in FIG. 11. Magnetic arm 640 includes a rod 642 defining a notch 643 for engagement with a retention ball such as ball 118 (FIG. 1). An upper end of rod 642 has pliant member 654 formed thereon and interposed between a removable magnet 644 and the upper end of rod 642. In this manner, magnet 644 can be readily articulated by angularly flexing with respect to a longitudinal axis of rod 642. Alternatively, pliant member 654 can be replaced by a ball and socket joint of a known configuration (not shown) to provide a desired angulation of magnet 644 with respect to rod 642. In such manner, one of the magnet 644 or rod 642 would be configured with a ball which is articulatingly received in a socket configured on the other of rod 642 or magnet 644.

Figure 12:
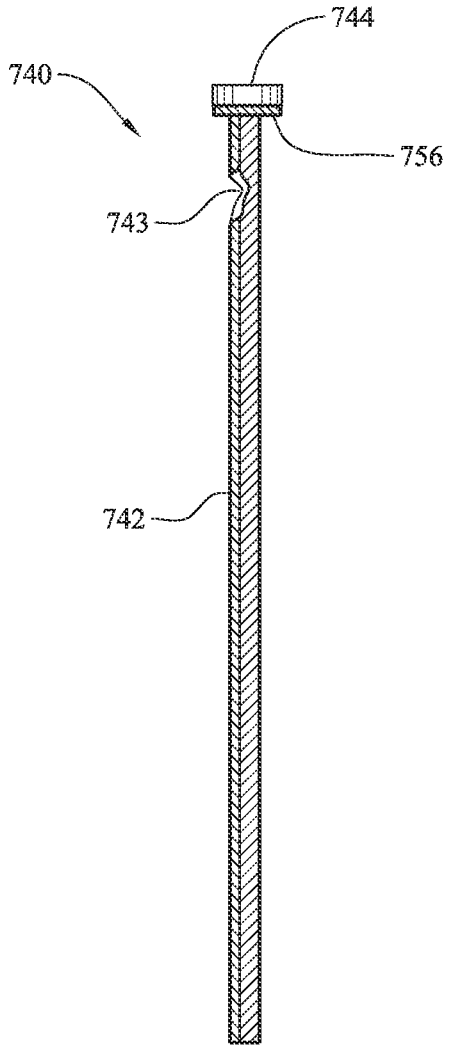
FIG. 12 presents an elevation view of an alternate embodiment magnetic arm wherein the rod has a rectilinear cross-section.

Still another alternate embodiment magnetic arm 740 is illustrated in FIG. 12. Magnetic arm includes a rod 742 having a rectilinear cross-sectional form and which defines a notch 743 for engagement with a retention ball such as ball 118 (FIG. 1). Rod 742 can also incorporate a plate 756 affixed to a top thereto and wherein magnet 744 is in turn affixed to plate 756.

Figure 15:
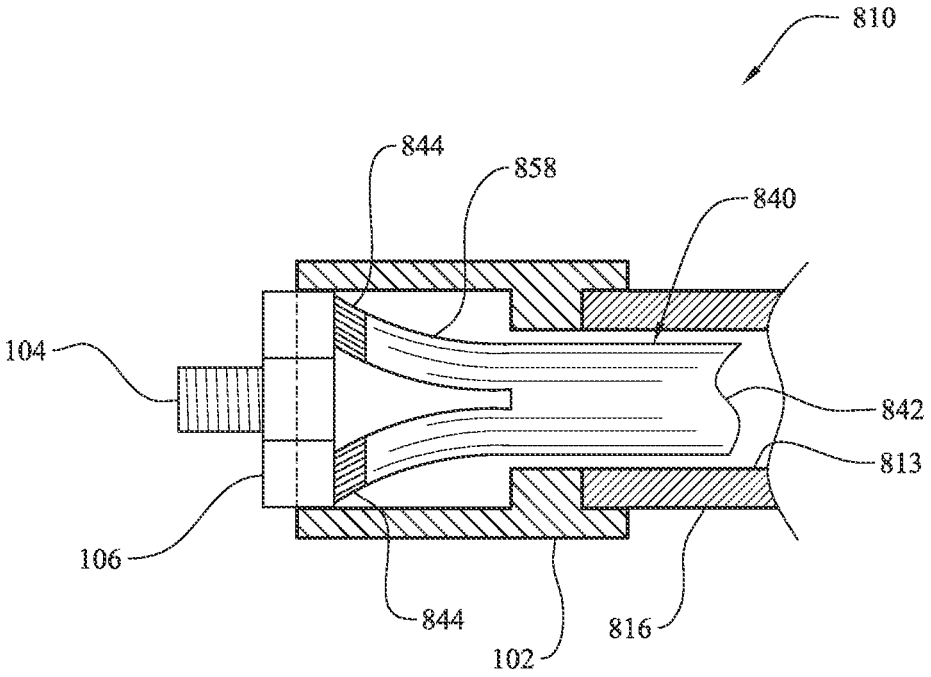
FIG. 15 presents an enlarged cross-section view of a wrench extension wherein the magnetic arm includes a split magnet on a biased end of the rod.

An alternate embodiment wrench extension assembly 810 is illustrated in FIG. 15; wherein its side adjustment is substantially identical to side adjustment 122 as discussed above and therefore is not shown. Socket head 102 is engaged on male end 816 and a bolt head 106 of bolt 104 is received in the open end of socket head 102. An alternate embodiment magnetic arm 840 is axially translatable into and out of central bore 113 of male end 816. Magnetic arm 840 comprises a rod 842 having a bifurcated end 852 configured to diverge one bifurcated end from another in a spring-like fashion and a bifurcated magnet 844 affixed to bifurcated end 852. The internal wall of male end 816 forming central bore 813 bears on the outsides of split end 858 and bifurcated magnet 844 and forces them toward a central axis to permit retraction into central bore 813. When extended, the spring-like resilience of bifurcated end 858 causes the bifurcated ends to diverge one from the other therefore producing a wider profile for bifurcated magnet to magnetically attract and stabilize bolt head 106 in socket head 102.

Figure 16:
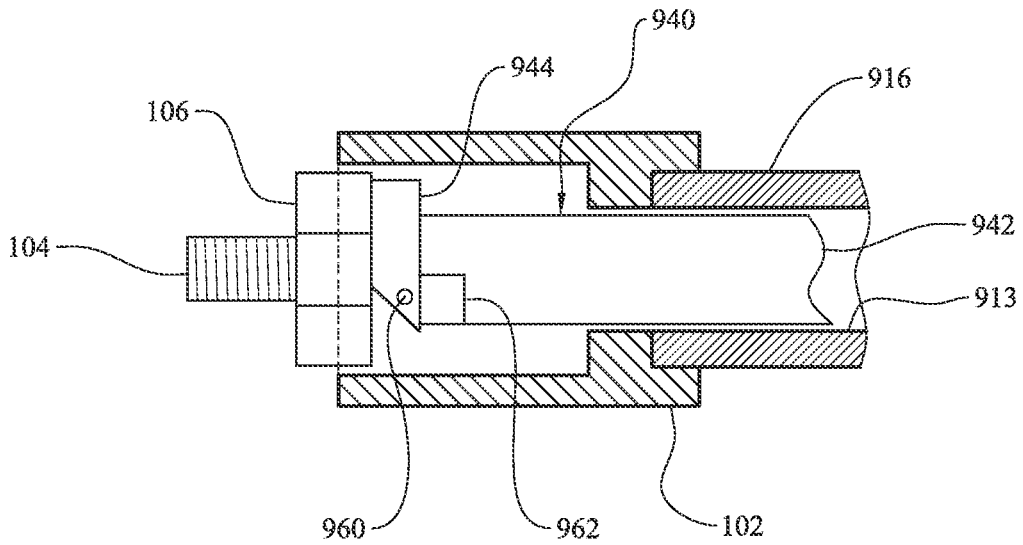
FIG. 16 presents an enlarged cross-section view of a wrench extension wherein the magnetic arm includes a magnet pivotally mounted to an end of the rod.

As illustrated in FIG. 16 an alternate embodiment wrench extension assembly 810 has a side adjustment substantially identical to side adjustment 122 as discussed above and therefore is not shown. Socket head 102 is engaged on male end 916 and a bolt head 106 of bolt 104 is received in the open end of socket head 102. An alternate embodiment magnetic arm 940 is axially translatable into and out of central bore 113 of male end 916. Magnetic arm 940 comprises a rod 942 having a magnet 944 affixed to an end thereof and pivotal about pivot pin 960. Rod 942 defines a notch 962 at the end to which magnet 944 is pivotally affixed to allow magnet 944 to pivot from a position substantially orthogonal to a longitudinal axis of rod 942 into axial alignment with rod 942 thereby permitting magnetic arm 940 to be retracted into central bore 913.

Figure 17:
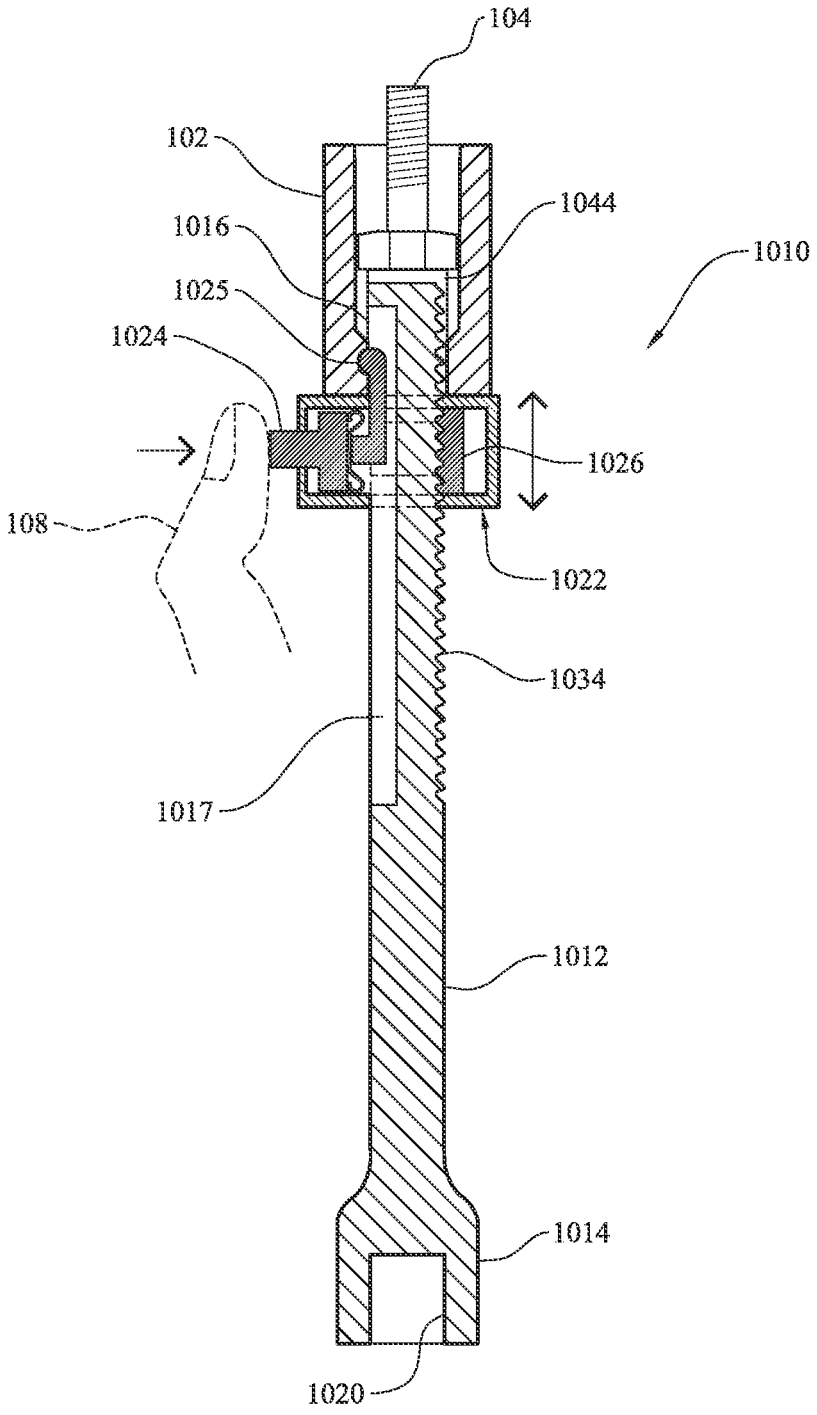
FIG. 17 presents an elevational cross-section view of an alternate embodiment wrench extension wherein the side adjustment mechanism axially translates a socket with respect to the extension.
Figure 18:
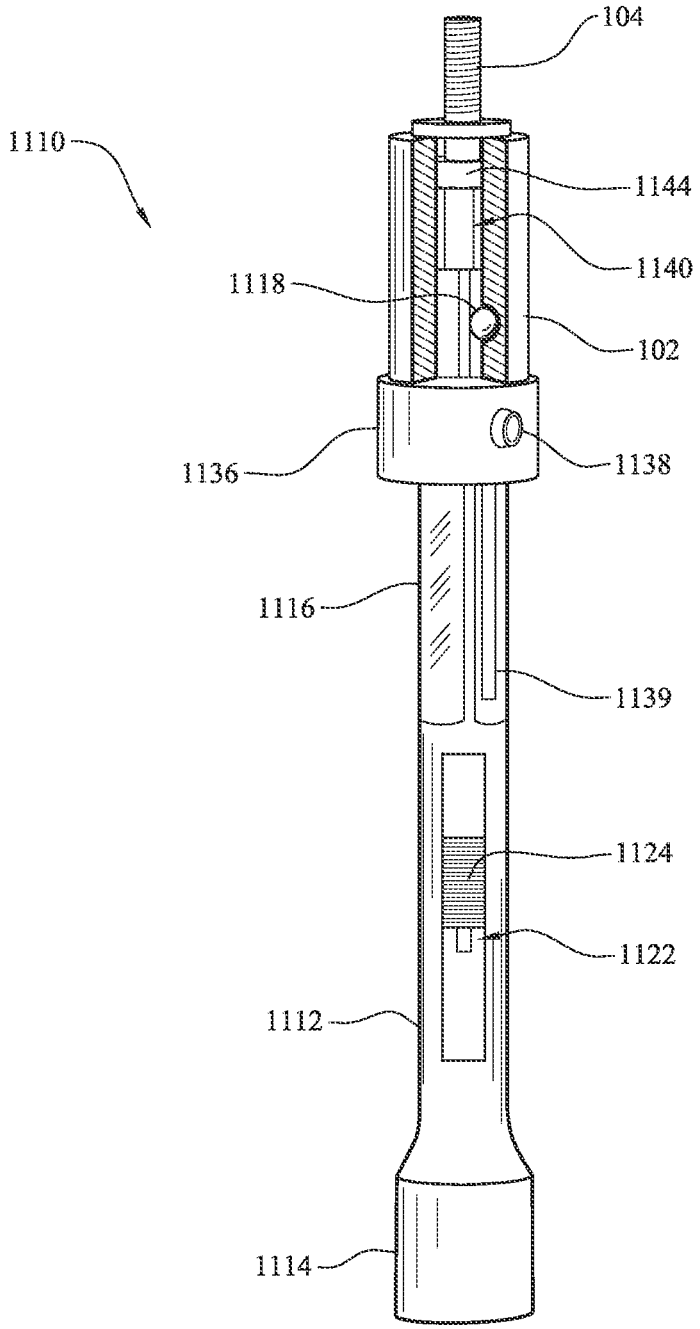
FIG. 18 presents an alternate embodiment wrench extension incorporating an external lockable collar to regulate the axial position of a socket on the wrench extension.

Yet another alternate embodiment of wrench extension assembly 1010 is illustrated in FIGS. 17 & 18, the wrench extension assembly 1010 comprising a shaft 1012 having a female end 1014 with a square recess 1020 formed therein for receiving the male nipple of a wrench handle. A male end 1016 is opposite from female end 1014 and is adapted to receive socket heads 102 thereon. Shaft 1012 further defines an axially aligned slot 1017 along the portion of shaft 1012, which is in registration with the segment of the shaft 1012 that configured as male end 1016 for receiving socket heads 102. A plurality of teeth 1034 are formed on a side of shaft 1012 opposite from slot 1017, and a magnet 1044 is affixed at an end of male end 1016. A side adjustment mechanism 1022 is axially movable along the portion of shaft 1012 defining slot 1017 and formed as male end 1016. Side adjustment mechanism 1022 includes a depressible slide 1024, which is mechanically linked to retention bulb 1025 for engaging an internal detent in a socket head 102 and also linked to latch 1026 for selective engagement and disengagement with teeth 1034.

In use, a socket head 102 is placed on male end 1016 until the internal detent in socket head 102 engages retention bulb 1025 at which point socket head 102 is engaged with movable side adjustment mechanism 1022. Depressible slide 1024 can be depressed by a user 108 to selectively engage and disengage latch 1026 with teeth 1034 and positionally adjust socket head axially along male end 1016 of shaft 1012. In this manner, user 108 can select the depth to which magnet 1044 protrudes into the well of socket head 102. A bolt 104 is magnetically retained by magnet 1044 within the well of socket head 102 to facilitate installation or removal of bolt 104 from a mechanical application desired by user 108. To remove socket head 102 from wrench extension assembly, depressible slide 1024 is depressed to disengage retention bulb 1025 from the internal detent in socket head 102 at which time the socket head 102 can be easily removed from male end 1016.

As shown in FIG. 18 an alternate embodiment wrench extension assembly 1110 includes a shaft 1112 having a female end 1114 adapted to receive the male nipple of a wrench handle. A male end 1116 is opposite from female end 1114 and is adapted to received socket heads 102 thereon. A magnetic arm 1140 having a magnet 1144 affixed to an end thereof is axially received in a central bore (not shown) of shaft 1112 and is axially translatable therein by side adjustment mechanism 1122 substantially the same as described in previous embodiment 110 above. A movable collar 1136 is sleeved over male end 1116 and is axially translatable along the length of male end 1116 configured to receive socket heads 102. Movable collar 1136 includes a locking feature 1138 interactive with slot 1139 defined in shaft 1112.

In use, a socket head 102 is engaged over male end 1116 and retention ball 1118 of male end 1116 engages a detent internally to socket 102. Socket head 102 is further axially positionable along male end 1116 by disengaging locking feature 1138 from slot 1139 and selectively repositioning movable collar 1136 along male end 1116. Side adjustment mechanism 1122 can then be used to axially translate magnetic arm 1140 with respect to shaft 1112 such that magnet 1144 is positioned within the well of socket head 102 to efficiently retain bolt 104 therein for installation or removal on a mechanical application.

Those practiced in the art will readily recognize that the magnets described above can be of various sizes to provide a desired magnetic force and also to be sufficiently small to extend through the different holes defined in socket heads 102. The magnets can also be larger to increase the surface area to further insure that the magnet will contact a desired bolt head or nut and provide the retention desired by a user.

The above disclosure is directed towards variations of a wrench extension assembly. The present invention can be adapted to a hand driver by modifying the female end of the wrench extension to include a commonly known grip. The grip can be removably attached to the female end or replace the female end thereof.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

I claim:

1. A wrenching tool extension for attaching to a wrenching handle, said wrenching tool extension comprising:

a shaft having a drive end adapted for attachment to a wrenching handle and a head receiving end defining an axial bore and further adapted to receive interchangeable socket heads;

a magnetic arm including a rod and a magnet affixed to one end of said rod, said magnetic arm axially received in said axial bore and oriented such that said magnet is positioned at said head receiving end of said shaft, said magnetic arm being axially translatable in said bore, said magnet being axially translatable relative to said shaft between a retracted position in which said magnet bears against said shaft head receiving end, and extended positions in which the magnet is adjustably extended away from said shaft head receiving end;

a side adjustment feature positioned on an external intermediate surface of said shaft and mechanically interfaced with said magnetic arm to axially translate said magnetic arm with respect to said shaft; wherein said head receiving end comprises a retention ball extending radially from a surface of said head receiving end, and said rod defines a notch therein, said notch selectively positionable to be in registration with said retention ball; wherein said notch in registration with said retention ball provides a socket releasing configuration, and further wherein said notch in other than registration with said retention ball provides a socket locking configuration; and wherein said notch is in registration with said retention ball when said magnet is arranged in said retracted position relative to said shaft, and said notch is in other than registration with said retention ball when said magnet is arranged in any of said extended positions in which the magnet is adjustably extended away from said shaft head receiving end.

2. The wrenching tool extension according to claim 1 wherein said side adjustment feature maintains said magnetic arm in a desired axial position with respect to said shaft.

3. The wrenching tool extension according to claim 2 wherein said side adjustment feature engages at least one of a plurality of ridges to maintain said magnetic arm in said desired axial position.

4. The wrenching tool extension according to claim 2 wherein said side adjustment feature includes a frictional element to maintain said magnetic arm in said desired axial position.

5. The wrenching tool extension according to claim 1 wherein said head receiving end is elongate and includes an axially movable collar thereon for adjusting the axial position of a tool head received thereon.

6. The wrenching tool extension according to claim 5 wherein said axially movable collar includes a locking feature for selectively retaining said movable collar in a selected axial position with respect to said head receiving end.

7. The wrenching tool extension according to claim 1 wherein said drive end is configured as a fixed handle.

8. A wrenching tool extension for attaching to a wrenching handle, said wrenching tool extension comprising:

a shaft having a drive end adapted for attachment to a wrenching handle and a head receiving end configured as a multi-faced socket nipple for receiving interchangeable sockets, and including a socket retention feature, said head receiving end further defining an axial bore;

a magnetic arm including a rod and a magnet affixed to one end of said rod, said magnetic arm axially received in said axial bore and oriented such that said magnet is positioned at said second end of said shaft, said magnetic arm being axially translatable in said bore, said magnet being axially translatable relative to said shaft between a retracted position in which said magnet bears against said shaft head receiving end, and extended positions in which the magnet is adjustably extended away from said shaft head receiving end;

a side adjustment feature positioned on an external intermediate surface of said shaft and mechanically interfaced with said magnetic arm to axially translate said magnetic arm with respect to said shaft; wherein said socket retention feature comprises a retention ball extending radially from one of said socket nipple faces, and said rod defines a notch therein, said notch selectively positionable to be in registration with said retention ball; wherein said notch in registration with said retention ball provides a socket releasing configuration, and further wherein said notch in other than registration with said retention ball provides a socket locking configuration; and wherein said notch is in registration with said retention ball when said magnet is arranged in said retracted position relative to said shaft, and said notch is in other than registration with said retention ball when said magnet is arranged in any of said extended positions in which the magnet is adjustably extended away from said shaft head receiving end.

9. The wrenching tool extension according to claim 8 further including a biasing spring internally retained in said socket nipple wherein said biasing spring biases said retention ball to a radially extended position.

10. The wrenching tool extension according to claim 9 wherein said rod of said magnetic arm includes a cut-away portion thereof defining a recess for clearance of said biasing spring.

11. The wrenching tool extension according to claim 8 wherein said rod of said magnetic arm defines an axial groove therealong for receiving a portion of said retention ball.

12. A wrenching tool extension for attaching to a wrenching handle, said wrenching tool extension comprising:

a shaft having a drive end adapted for attachment to a wrenching handle and a head receiving end defining an axial bore and further adapted to receive interchangeable socket heads;

a magnetic arm including a rod and a disc shaped magnet rigidly affixed to one end of said rod, said magnetic arm axially received in said axial bore and oriented such that said magnet is positioned at said head receiving end of said shaft, said magnetic arm being axially translatable in said bore, said magnet being axially translatable relative to said shaft between a retracted position in which said magnet bears against said shaft head receiving end, and extended positions in which the magnet is adjustably extended away from said shaft head receiving end;

a side adjustment feature positioned on an external intermediate surface of said shaft and mechanically interfaced with said magnetic arm to axially translate said magnetic arm with respect to said shaft; wherein said head receiving end comprises a retention ball extending radially from a surface of said head receiving end, and said rod defines a notch therein, said notch selectively positionable to be in registration with said retention ball; wherein said notch in registration with said retention ball provides a socket releasing configuration, and further wherein said notch in other than registration with said retention ball provides a socket locking configuration; and wherein said notch is in registration with said retention ball when said magnet is arranged in said retracted position relative to said shaft, and said notch is in other than registration with said retention ball when said magnet is arranged in any of said extended positions in which the magnet is adjustably extended away from said shaft head receiving end.

13. The wrenching tool extension according to claim 12 wherein said rod comprises an upper rod having said magnet affixed to one end thereof and a lower rod wherein one of said rods includes male threads and another of said rods includes female threads for removably attaching said rods one to the other.

14. The wrenching tool extension according to claim 12 wherein one of said magnet and said rod includes male threads and another of said magnet and said rod includes female threads for removably attaching said magnet to said rod.

15. The wrenching tool extension according to claim 12 wherein a pliant member is interposed between said magnet and said end of said rod to permit said magnet to angularly flex with respect to a longitudinal axis of said rod.

16. The wrenching tool extension according to claim 12 wherein said magnet and said end of said rod are bifurcated and extendable between a retracted position and an extended position and further wherein said bifurcations are biased one away from another when in said extended position.

17. The wrenching tool extension according to claim 12 wherein said magnet is pivotally attached to said rod end, said magnet pivotal between an axially aligned orientation and an axially orthogonal position with respect to a longitudinal axis of said rod.

* * * * *